US009348346B2

(12) United States Patent
Abhishek et al.

(10) Patent No.: US 9,348,346 B2
(45) Date of Patent: May 24, 2016

(54) VOLTAGE REGULATION SUBSYSTEM

(71) Applicants: Kumar Abhishek, Ghaziabad (IN); Siddi Jai Prakash, New Delhi (IN); Kushal Kamal, New Delhi (IN)

(72) Inventors: Kumar Abhishek, Ghaziabad (IN); Siddi Jai Prakash, New Delhi (IN); Kushal Kamal, New Delhi (IN)

(73) Assignee: FREESCALE SEMICONDUCTOR, INC., Austin, TX (US)

( * ) Notice: Subject to any disclaimer, the term of this patent is extended or adjusted under 35 U.S.C. 154(b) by 175 days.

(21) Appl. No.: 14/457,129

(22) Filed: Aug. 12, 2014

(65) Prior Publication Data

US 2016/0048147 A1 Feb. 18, 2016

(51) Int. Cl.
*G05F 1/46* (2006.01)

(52) U.S. Cl.
CPC ..... *G05F 1/468* (2013.01)

(58) Field of Classification Search
CPC ..... G05F 3/30
See application file for complete search history.

(56) References Cited

U.S. PATENT DOCUMENTS 4,071,884 A * 1/1978 Maigret ..... H02M 3/33507 315/241 P
4,451,742 A 5/1984 Aswell
5,428,252 A 6/1995 Walker
5,528,129 A * 6/1996 Kaneko ..... G05F 3/247 323/313
5,841,643 A * 11/1998 Schenkel ..... H02M 3/33507 323/282
5,886,561 A * 3/1999 Eitan ..... H02J 9/061 307/64
6,118,188 A 9/2000 Youssef
6,654,264 B2 11/2003 Rose
6,671,816 B1 12/2003 Woo
6,766,222 B1 7/2004 Duley
6,809,504 B2 10/2004 Tang
7,080,268 B2 7/2006 Mosley
7,148,670 B2 12/2006 Inn
7,279,927 B2 10/2007 Falkowski
7,286,005 B2 10/2007 Jiang
7,301,313 B1 11/2007 Hart
7,348,848 B2 * 3/2008 Huang ..... H03F 3/45183 330/253
7,376,847 B2 5/2008 Chen
7,397,228 B2 7/2008 Barrows
7,518,355 B2 4/2009 Grassi
7,535,284 B2 5/2009 Ito
7,608,942 B2 10/2009 Chun
7,679,344 B2 3/2010 Carlson
7,705,575 B2 * 4/2010 Akyildiz ..... H02J 9/005 323/274
7,739,528 B2 6/2010 Zhuang
7,770,037 B2 8/2010 Searles
7,800,433 B2 9/2010 Yoshikawa
7,812,582 B2 10/2010 Eoan
7,973,595 B2 7/2011 Kimura (Continued)

OTHER PUBLICATIONS

IBM, "Method for Monitoring and Providing Power Fault Protection in a Multiprocessor System Powered by Multiple Voltage Regulator Modules", WWW.IP.COM, No. IPCOM000126452D, Jul. 18, 2005.

*Primary Examiner* — Timothy J Dole
*Assistant Examiner* — Yusef Ahmed
(74) *Attorney, Agent, or Firm* — Charles E. Bergere

(57) ABSTRACT

A voltage regulation subsystem for a microprocessor has both internal and external regulation modes. An internal auxiliary voltage regulator is selectively enabled to overdrive the voltage. The enablement of the auxiliary voltage regulator is contingent upon a comparison of bandgap references of the internal and external regulators used in the respective regulation modes, which boosts the supply voltage, enables circuitry supplied by the external regulator (with the assistance of auxiliary voltage regulators) to boot robustly in extreme Process-Voltage-Temperature (PVT) conditions.

13 Claims, 5 Drawing Sheets

(56) References Cited

U.S. PATENT DOCUMENTS 8,010,819 B2 8/2011 Pastorello
8,020,017 B2 9/2011 Padhye
8,022,684 B2 * 9/2011 Bitting ..... G05F 3/16 323/313
8,080,897 B1 12/2011 Virutchapunt
8,161,431 B2 4/2012 Buonpane
8,164,378 B2 4/2012 Pietri
8,279,646 B1 10/2012 Hamstra
8,362,757 B2 1/2013 Sessions
8,458,503 B1 6/2013 Yihia
8,638,084 B1 * 1/2014 Abugharbieh ..... G11C 5/147 323/313
8,653,884 B2 2/2014 Miwa
2005/0024035 A1 2/2005 Tabaian
2005/0110477 A1 * 5/2005 Mauthe ..... G05F 1/465 323/316
2006/0276986 A1 * 12/2006 Anderson ..... G01R 31/31703 702/99
2007/0014176 A1 * 1/2007 Krenzke ..... G11C 16/30 365/226
2007/0120544 A1 * 5/2007 Ritter ..... G05F 1/575 323/281
2007/0271473 A1 11/2007 Hosomi
2008/0007244 A1 * 1/2008 Draxelmayr ..... G05F 3/30 323/316
2008/0169866 A1 * 7/2008 Kleveland ..... G05F 3/30 327/539
2009/0189590 A1 * 7/2009 Ide ..... G05F 3/30 323/313
2010/0026377 A1 * 2/2010 Weder ..... G05F 1/561 327/538
2010/0164469 A1 7/2010 Bansal
2010/0253314 A1 * 10/2010 Bitting ..... G05F 3/16 323/313
2011/0084552 A1 4/2011 Faerevaag
2012/0194151 A1 8/2012 Gunther
2012/0326517 A1 12/2012 Narwal
2013/0021091 A1 1/2013 Robertson
2013/0093505 A1 * 4/2013 Gupta ..... G05F 1/575 327/540
2013/0221937 A1 8/2013 Yan
2014/0253073 A1 * 9/2014 Moon ..... H02M 1/44 323/281
2015/0048879 A1 * 2/2015 Fung ..... G05F 3/30 327/539
2015/0194886 A1 * 7/2015 Zanetta ..... H02M 3/158 327/309

* cited by examiner

- PRIOR ART -

- PRIOR ART -

VOLTAGE REGULATION SUBSYSTEM

BACKGROUND OF THE INVENTION

The present invention relates generally to a voltage regulation subsystem and, more particularly, to regulation subsystems for microprocessor circuitry.

Microprocessor circuitry, such as SoCs conventionally include on-chip voltage regulation and a digital logic controller to regulate their voltage supply. As microprocessor circuitry develops to operate at higher frequencies and as the density of transistors on integrated circuits increases, the vastly increased number of transitions in transistor state in the limited area of each integrated circuit leads to ever greater current demand and thermal stresses. Mechanisms are therefore needed to manage power in such systems.

Recent trends towards the increased use of multi-core and SoC systems make the development and improvement of such power management mechanisms all the more urgent. It has therefore become common to supply recent generations of microprocessor circuitry with power indirectly using a voltage regulator configured to supply a suitable current and a "well-regulated" voltage while preserving desired transient response characteristics.

Conventionally voltage regulators have been implemented as components integrated on the same chip as the microprocessor core, where each core has its own voltage control. The voltage regulator will also typically take the supply voltage and step it down to a lower voltage, as required by the microprocessor core. In this respect the voltage regulator implements a "buck converter" or a Low Drop Out (LDO) linear regulator, stepping-down the supply voltage to a DC voltage required by the core. Voltage regulators need to be adapted to respond to changes of load current at time scales similar to those changes. Other performance constraints include efficiency (i.e., minimization of losses) and power density.

Load current in SoC systems can change whenever a microprocessor, or other circuit component, enters an inactive (i.e., "sleep") mode or an active mode (i.e., so-called e-states and c-states). Additionally, certain microprocessor architectures also power gate or switch off the power for different domains as required. Changes in load current can themselves induce transient effects (often referred to as "transients"). The rate of changes in load levels for more recent "high transistor density" systems is high, commensurate with the higher clock speeds of these systems.

In typical implementations, voltage regulation is managed by a power management controller (PMC). PMCs conveniently also include units (i.e., digital logic controller units, DLCs) that monitor power on reset (POR) and low voltage detection (LVD) values. POR signals are generally of two types: high voltage, HV_supply_POR and low voltage, LV_supply_POR. These POR signals enable the transistors operating in high voltage (HV) logic and low voltage (LV) logic respectively. The LVD and POR indicators can be on the same supply source but the respective voltages at which they trigger may differ. For instance, with a 1.2V supply, (LV) POR threshold can be at 0.7V while LVD is at 1.08V. Voltage regulation together with POR and LVD monitoring is intended to ensure safe device operation. The LVD monitor tracks PMC supply voltage VDDREG, VDD digital core voltage supply, and VDDSYN with high precision, while the POR monitor checks main regulator supply VDDREG and VDD digital core voltage supply.

While it has become conventional to locate voltage regulators as close as possible to the most significant loads (i.e., microprocessor cores) and therefore to provide on-chip voltage regulators, there are nevertheless scenarios where "off-chip" voltage regulation may be considered. For example, when the current requirement is very high and the die area is limited.

Certain SoC systems offer both internal and external regulation modes. External regulation relies on an external regulator that works on an external bandgap. This external bandgap is a reference voltage that is factory calibrated to provide a reliable voltage over a known temperature range and supply voltage variation, say 0.62V, with some variation. Internal regulators have corresponding internal bandgap reference voltages. There can however be a non-correlation of external and internal bandgap variation over process and temperature.

Depending upon the requirements of the PMC and the regulated circuitry, the bandgap and LVD comparator may be tuned to prevent the reference from exceeding a specific threshold, say 1.15V. This is achieved by applying a known digital bit value to a comparator—commonly known as "trim". The PMC typically includes a dedicated memory such as an EEPROM for storing a table of trim bit values. In certain circumstances, a bandgap may exceed or fail to achieve design expectations, so by selecting appropriate points on the bandgap output the effective bandgap may be tuned to match the design expectations.

During power up and reset the bandgap is typically untrimmed. The range of variation of LVD reference, which at this stage includes the untrimmed bandgap variation, is much higher than that once trimmed levels are applied. As long as the supply voltage is higher than the untrimmed LVD threshold, the use of an untrimmed bandgap allows the regulated circuitry to exit reset. In some cases, this requires the software or a user to overdrive the supply voltage at power up and reset. Untrimmed range is used before the bandgap trims get loaded from dedicated memory (i.e., flash memory). Thus, during power up and before the flash memory is read, the LVD reference variation may be high. The trim is then applied once the reset process (performed by a reset generation module, RGM) is complete. In fact, trims are applied only after the system has determined that the supply voltage exceeds the untrimmed levels of the bandgap and that LVD comparators have tripped.

To improve the performance of such external regulators in the face of non-correlation between external and internal bandgap variation, it is known to disable the PMC units that provide core LVD/HVD monitoring at first boot and/or to increase the core voltage specification to counter the untrimmed LVD levels. If the PMC units are disabled, external off-chip LVD monitors are required instead, which adds complexity and cost. If, on the other hand, core voltage is increased to counter LVD untrimmed range (while the internal LVD monitoring unit of the SoC is enabled), it leads to higher power consumption in operating mode.

In the latter option, core voltage is increased rather than attempting to reduce the untrimmed LVD level. Untrimmed LVD levels cannot be reduced as this may lead to a number of challenges arising from low supply voltage. If the untrimmed LVD levels were reduced, allowing the supply voltage to drop to a reduced level without triggering the LVD comparator, this would at some point increase power consumption. Furthermore, if the supply voltage were to go below a certain Vmin, where Vmin is the voltage at which timing has been met for the entire digital logic, timing related setup and hold violation would ensue leading to complete failure of the functional behavior of the SoC.

It is also seen that certain external regulators designed with low bandwidth, lack fast load transition capabilities. These regulators require internal circuitry (referred to as "auxiliary regulators" or AUX regulators) to support fast load transition. In cases where internal AUX regulators are used to support load transition, these AUX regulators are enabled only when the system detects that supply exceeds an LVD threshold. If untrimmed variation on the bandgap is too great, the LVD threshold (which is related to the bandgap) becomes high and hence if core voltage from external supply approaches minimum operating voltage, the supply may not exceed the LVD threshold and hence AUX regulator cannot be enabled. Furthermore, the internal bandgap variation may be completely unrelated to the external supply bandgap variation. Hence these internal AUX regulators cannot be used reliably with existing architectures for voltage regulation upon boot (power-on) or reset.

If the LVD/HVD monitoring units are not disabled at first boot (POR), i.e., before untrimmed LVD reference levels are released, it is possible the untrimmed LVD reference voltage will vary sufficiently that it exceeds the minimum supply voltage, the LVD monitor unit will not assert and the AUX regulator will remain in the "off" state—meaning that the regulated supply would never go above the LVD level and hence circuitry never exits the reset process.

It is also possible that, were the AUX regulator enabled at power on reset (POR) (the POR threshold being ~600 mV for a 1.2V supply, say), this could result in an unwelcome electrostatic discharge (ESD) as low voltage circuitry in the PMC ramps up. The AUX regulator would operate to pull the supply voltage to operating level (i.e., 1.2V) from the POR threshold level (i.e., 0.6V) in a sudden inrush (e.g., with a time scale in the order of 200 ns). This happens because the conventional internal AUX regulator is designed to handle load transition and has a capability to inject large current to correct the voltage. This sharp jump can cause ESD protection circuits to trigger.

A further challenge arises when attempting to use known verification techniques. While internal regulator behavior is understood and load transitions may be verified using known methods, no such capability exists for external regulation mode. In such multi-regulation subsystems, currently there is therefore a requirement for a method to verify the functionality and electrical behaviors of systems having internal regulators at start-up, as well as load transition and mode transition behaviors in such systems.

BRIEF DESCRIPTION OF THE DRAWINGS

The invention, together with objects and advantages thereof, may best be understood by reference to the following description of preferred embodiments together with the accompanying drawings in which.

DETAILED DESCRIPTION OF PREFERRED EMBODIMENTS

Figure 1:
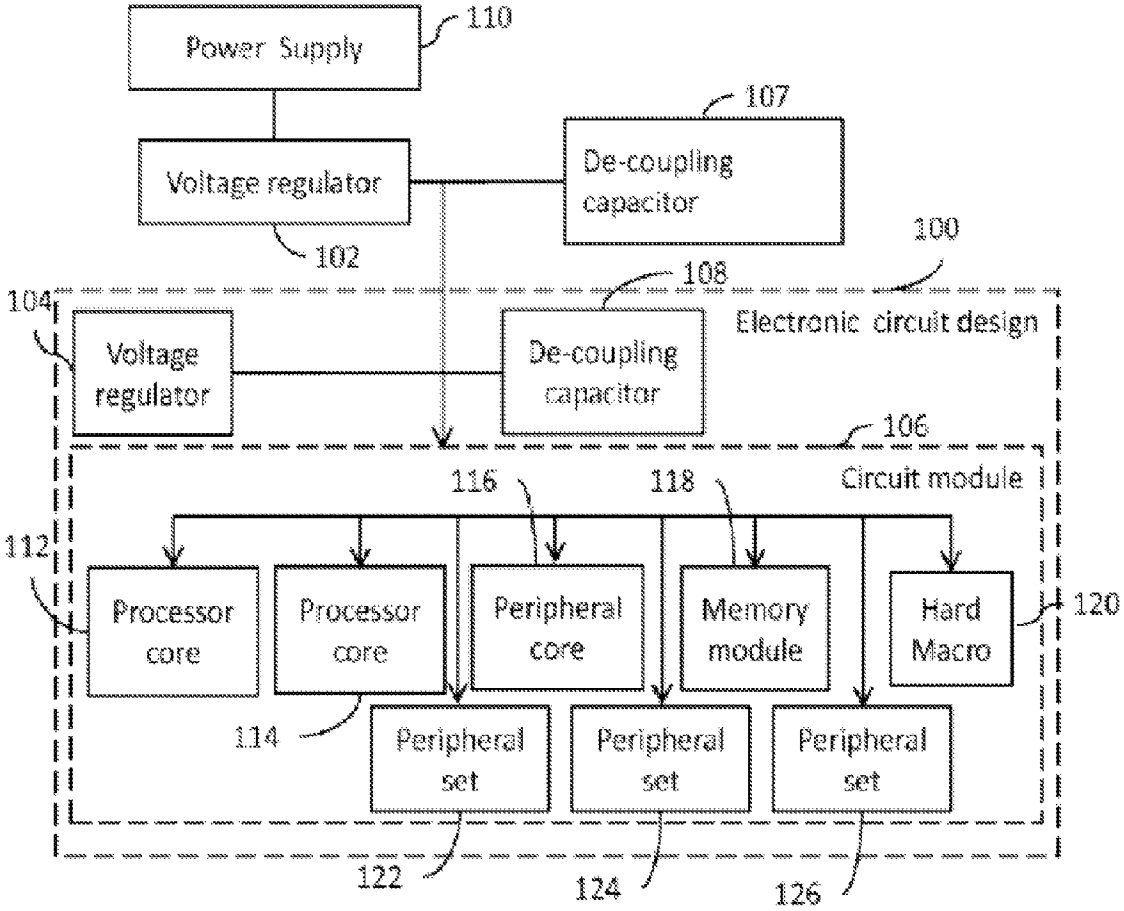
FIG. 1 is a schematic block diagram of a known electronic circuit having internal and external voltage regulation.

The detailed description set forth below in connection with the appended drawings is intended as a description of presently preferred embodiments of the invention, and is not intended to represent the only forms in which the present invention may be practised. It is to be understood that the same or equivalent functions may be accomplished by different embodiments that are intended to be encompassed within the spirit and scope of the invention. In the drawings, like numerals are used to indicate like elements throughout. Furthermore, terms "comprises," "comprising," or any other variation thereof, are intended to cover a non-exclusive inclusion, such that module, circuit, device components, structures and method steps that comprises a list of elements or steps does not include only those elements but may include other elements or steps not expressly listed or inherent to such module, circuit, device components or steps. An element or step proceeded by "comprises . . . " does not, without more constraints, preclude the existence of additional identical elements or steps that comprises the element or step.

In one embodiment, the present invention provides a voltage regulation system for regulating voltage in an integrated circuit. The system includes an auxiliary regulator, a bandgap comparator and an interface with an external regulator. The bandgap comparator compares an external regulator bandgap with an internal reference voltage and outputs a comparison signal to the auxiliary regulator. The auxiliary regulator is enabled if the comparison signal indicates that the external regulator bandgap voltage is less than the internal reference voltage and a predetermined offset. The enabled auxiliary regulator boosts a supply voltage in accordance with a predetermined criterion, thereby ensuring that the integrated circuit comes out of reset.

In another embodiment, the present invention provides a method for regulating voltage in an integrated circuit. The method includes receiving an external regulator bandgap voltage from a first voltage regulator that is external to the integrated circuit; receiving an internal reference voltage from a reference generator that is internal to the integrated circuit; comparing, with a bandgap comparator, the external regulator bandgap voltage and the internal reference voltage; outputting a comparison signal to an auxiliary regulator; enabling the auxiliary regulator if the comparison signal indicates that the external regulator bandgap voltage is less than the internal reference voltage and a predetermined offset; and boosting, at the enabled auxiliary regulator, a supply voltage in accordance with a predetermined criterion, thereby ensuring that the integrated circuit comes out of reset.

In yet another embodiment, the present invention provides a method for verifying power management in an integrated circuit design using an external design verification apparatus. The integrated circuit design includes an auxiliary regulator, a bandgap comparator, and a plurality of load modules. The method comprises: generating an estimated current load requirement of the load modules based on a predefined current load model; testing the integrated circuit design with the external design verification apparatus using the estimated current load requirement by executing predetermined test patterns that include patterns corresponding to one or more of start-up, mode transition and load transition, and during the testing: comparing, in the bandgap comparator, an external regulator bandgap voltage and an internal reference voltage, outputting a comparison signal from the bandgap comparator to the auxiliary regulator, enabling the auxiliary regulator if the comparison signal indicates that the external regulator bandgap voltage is less than the internal reference voltage and a predetermined offset, and monitoring a supply voltage of the integrated circuit design. The supply voltage is regulated by the enabled auxiliary regulator. The enabled auxiliary regulator boosts the supply voltage in accordance with a predetermined criterion. The method further includes verifying that the supply voltage regulation performed by the auxiliary regulator, which is based on the estimated current load requirement, does not deviate from a predetermined operating voltage of the integrated circuit design.

In a further embodiment of the present invention, there is provided an electronic design verification apparatus including at least one processor and at least one memory in communication with the processor. The memory is used to store an integrated circuit design and a predefined current load model of the integrated circuit design. The electronic design verification apparatus is configured to verify power management in the circuit design, where the circuit design includes an auxiliary regulator, a bandgap comparator and a plurality of load modules. The electronic design verification apparatus performing steps including: estimating a current load requirement of the load modules based on a predefined current load model; executing predetermined test patterns in conjunction with the estimated current load requirement, where the test patterns include patterns corresponding to one or more of start-up, mode transition and load transition; comparing, for each test pattern, with the bandgap comparator, an external regulator bandgap voltage with an internal reference voltage; outputting a comparison signal from the bandgap comparator to the auxiliary regulator; enabling the auxiliary regulator if the comparison signal indicates that the external regulator bandgap voltage is less than the internal reference voltage and a predetermined offset; monitoring a voltage supplied to the integrated circuit design; regulating the voltage supplied to the integrated circuit design using the enabled auxiliary regulator, where the enabled auxiliary regulator boosts the supply voltage in accordance with a predetermined criterion; and verifying that the supply voltage regulation performed by the auxiliary regulator, which is based on the estimated current load requirement, does not deviate from a predetermined operating voltage of the integrated circuit design.

In accordance with the present invention, an internal auxiliary voltage regulator may be selectively enabled to reduce or even minimize contention between the regulation modes. The enablement of the auxiliary voltage regulator may be made contingent upon a comparison of the bandgap reference voltages used in the respective regulation modes so that circuitry supplied from external regulators (with the assistance of auxiliary voltage regulators) can boot robustly in extreme Process-Voltage-Temperature (PVT) conditions. The above method provides a robust startup sequence for external regulation mode.

Certain embodiments are described in which internal AUX regulators are adapted so that they may be used without the difficulties noted above, in particular during power on and reset (POR) procedure. As noted earlier, AUX regulators are able to inject large current to correct the supply voltage. For example, a given AUX regulator may provide a current of up to 60 mA. Under normal conditions the main VDD grid might be expected to draw a current of, say, 30 mA, which is lower than the maximum current available from the AUX regulator and supply voltage would be regulated without approaching the maximum capacity of the regulator. These conditions are referred to as "under-drive" conditions.

This contrasts with conditions, such as at start-up, where the AUX regulator seeks to provide the maximum current possible in order to charge the capacitive load connected on the entire grid, which was discharged initially. In this scenario, the AUX regulator functions in "over-drive mode".

The AUX regulator is provided with an interface that is configured to allow the external bandgap to be sensed. The AUX regulator is then operated in an over-drive mode during a POR procedure, returning to a conventional AUX regulator (under-drive) configuration for run time operating conditions in the post-trim stage of the reset state machine (i.e., the Reset Generation Module, RGM). In certain of these embodiments, the external bandgap sensing interface is the POR_FROM_PAD port.

As a result of the above, certain embodiments of the present invention also allow for the functional and electrical verification of the challenges in a multi-regulation system. The in-built notifiers can create hardware resets for all failing conditions to gate the system effectively and without any additional overhead of creating flags, etc. In addition, certain embodiments of the present disclosure facilitate identification of contention regions early in design and make corrections in design or software possible before that microprocessor design is committed to hardware (e.g., applied to silicon chip or other substrate).

Referring now to FIG. 1, a schematic block diagram of a conventional integrated circuit 100 having internal and external voltage regulation is shown. The integrated circuit 100 includes first and second voltage regulators 102 and 104, a circuit module 106, first and second de-coupling capacitors 107 and 108, and a power supply 110. The integrated circuit 100 may be a system-on-chip (SoC), a microcontroller unit (MCU), an application specific integrated circuit (ASIC) or any other circuit and may be used to control critical applications. The circuit module 106 may be a digital circuit, an analog circuit, or a combination thereof (i.e., a mixed signal circuit) that requires power management. The circuit module 106 may include multiple modules, such as processor cores 112 and 114, a peripheral core 116, a memory module 118, a hard macro 120 and peripheral sets 122-126.

As is known in the art, the term "hard macro" refers to a circuit having a defined structure and layout. When verifying circuits in simulations, the term is used to refer to circuit components such as Flash and SRAM memories whose characteristics are well understood and need not be specifically synthesised. The term contrasts with "soft logic" such as the core of a SoC.

The first voltage regulator 102 is off-chip (outside the integrated circuit 100) and operates to regulate voltage supplied to the circuit module 106. Such off-chip regulators are typically low cost and regulate voltage over a low bandwidth (typically in the range of 30 KHz). The second voltage regulator 104 is an on-chip voltage regulator that provides voltage to the circuit module 106 and supports the first voltage regulator 102 during high power surges.

The first and second de-coupling capacitors 107 and 108 are charged by the first and second voltage regulators 102 and 104, respectively and provide additional voltage (a "voltage boost") to the first and second voltage regulators 102 and 104, during high current demands of the circuit module 106. The power supply 110 provides power to the first voltage regulator 102, which in turn provides power to the circuit module 106. The voltage requirements of the circuit module 106 depend on the activities and modes of operation of the circuit module 106. For example, the voltage requirements may depend on the load on the circuit module 106, number of active modules within the circuit module 106, clock frequency, and other operating specifications of the circuit module 106.

Voltage regulators may conveniently be constructed using semiconductor devices that operate in a switched mode: such regulators are also known as Switched Mode Power Supplies (SMPS). When the SMPS operates in an "off" state, its current is zero, whereas when the SMPS operates in an "on" state, the voltage drop across the SMPS is small, ensuring that the overall power dissipated is also small. An SMPS regulates voltage by varying the ratio of "on" state to "off" state time.

An alternative regulator architecture, known as a Low Drop Out (LDO) linear regulator, may be used together with an SMPS. LDOs have advantages when faster transient response is required and may be more efficient when output voltage is close to the input voltage (maximum efficiency being proportional to the ratio between output and input voltage)

Figure 2:
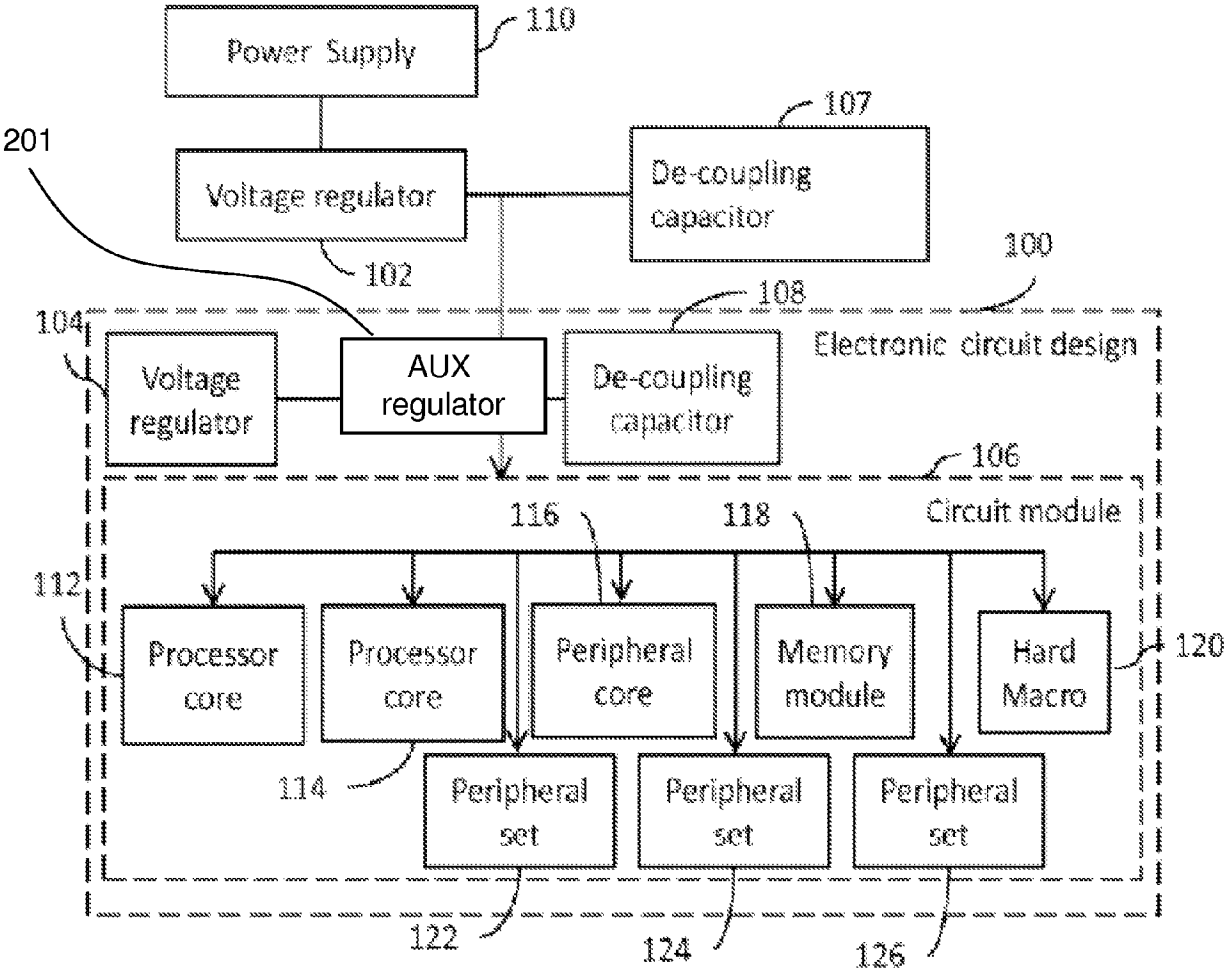
FIG. 2 is a schematic block diagram of an electronic circuit incorporating an on-chip auxiliary regulator.

FIG. 2 shows a variation of the integrated circuit 100 of FIG. 1, where the external regulator is assisted during load transition by the operation of an auxiliary regulator 201 (or AUX regulator), in accordance with an embodiment of the present invention. Like reference signs are used for corresponding functional blocks.

Here, an AUX regulator 201 governs whether the regulated supply voltage from a first, off-chip, voltage regulator 102 is supplied to the circuit 100 or not. When the AUX regulator 201 is enabled, the voltage supplied to the integrated circuit 100 is supplied from the first voltage regulator 102, otherwise, the voltage supplied to the integrated circuit 100 is supplied from a second on-board voltage regulator 104. The AUX regulator 201 may be enabled during load transitions. This arrangement ensures that, during load transition, there is no contention between the respective regulators 102 and 104.

Figure 3:
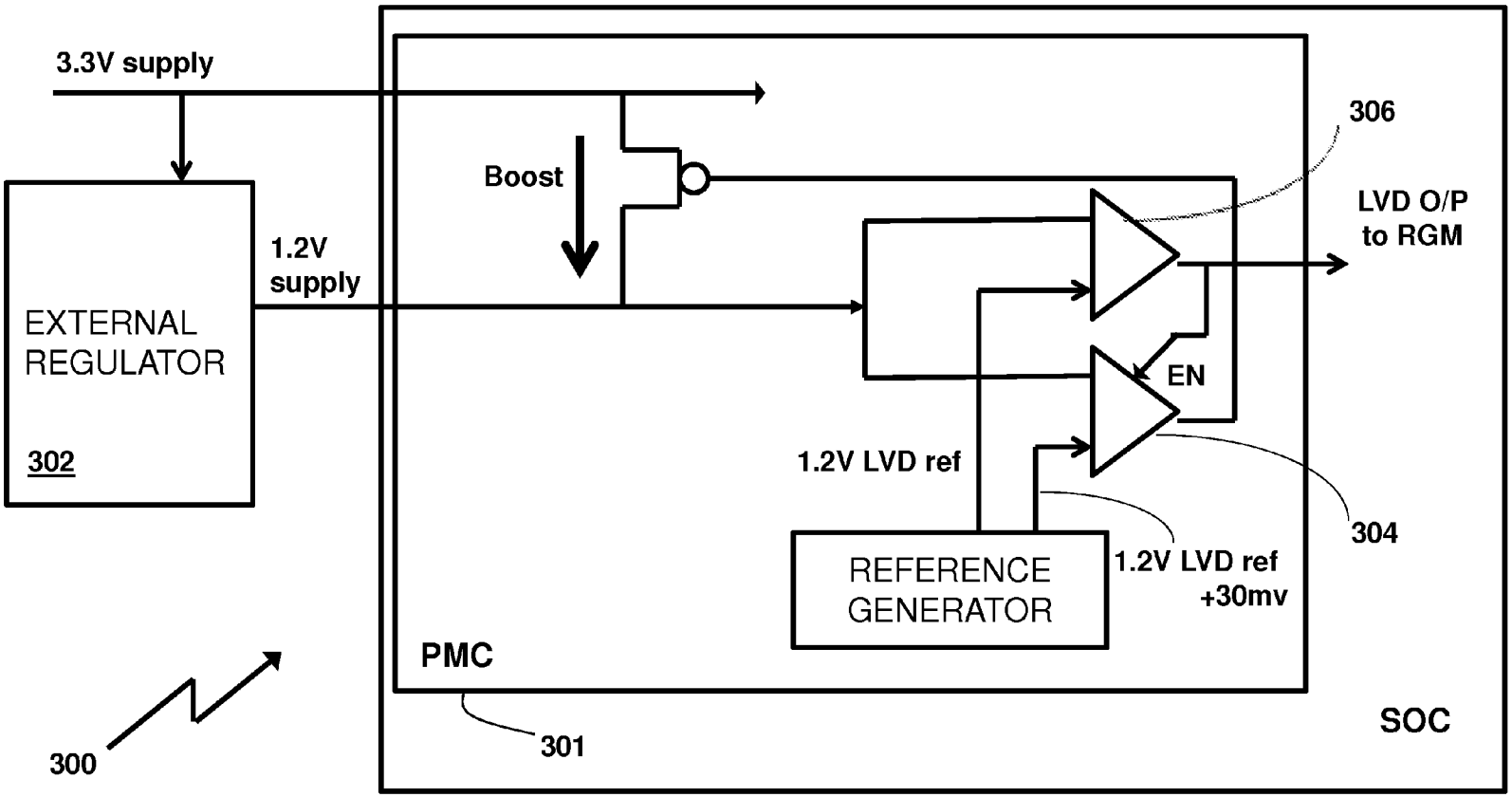
FIG. 3 is a schematic circuit diagram of voltage regulator circuitry.

FIG. 3 is a schematic block diagram of conventional voltage regulator circuitry. FIG. 3 shows a SoC 300 including an analog power management circuit (PMC) 301. The PMC 301 is electrically connected to an external regulator 302 and receives a supply voltage (at a nominal 3.3V) from an external supply. The external regulator 302 operates to supply a regulated reduced voltage supply (at a nominal 1.2V) to the PMC 301. The PMC 301 includes an internal reference voltage generator (having a corresponding internal bandgap), an AUX regulator 304 and an internal regulator 306.

In FIG. 3, the AUX regulator 304 is enabled (EN) with LVD release (i.e., once the internal regulator 306 confirms that the external 1.2V supply exceeds the LVD reference voltage). Alternatively, the AUX regulator 304 may be disabled by the user (by system software) regardless of LVD release. This configurability is not present by default when the SoC 300 is shipped from the fabrication plant; it can however be programmed once the SoC 300 comes out of reset for the first time after fabrication.

The internal regulator 306 generates an output signal that is applied to a reset manager (RGM, not shown), which then performs a reset procedure in the SoC 300.

A typical AUX regulator default level is (LVD level +30 mV) and its purpose is to give a current boost when the external supply (here denoted the "1.2V supply") drops due to load transition. If LVD is not released by the internal regulator 306, the AUX regulator 304 will never be enabled and in fact, the SoC 300 is stuck in reset.

A further problem may arise during supply shut-off, where the AUX regulator 304 has been enabled successfully. By remaining enabled at shut-off, the AUX regulator 304 may create contention with ramp down of the external regulator 302. It is thus desirable that there be a facility to disable the AUX regulator 304 before powering off the SoC 300.

The known use of an AUX regulator as illustrated in FIG. 2 or FIG. 3 does not, however, address certain critical areas such as:

a) Startup behavior—In a multi-regulation system, the internal SoC AUX regulators are there to support load transition only. They are disabled during boot and power-down to avoid unpredictable behavior due to contention issues.

b) "Design for Test" (DFT) modes—problems can arise when AUX regulators turn ON during scan shift. Scan shift is a DFT method to test the sea of gates logic inside a SoC, i.e., for timing closure, stuck-at faults, etc. Conventionally, AUX regulators need to be turned OFF during such DFT modes.

c) Mode transition—problems may also occur when mode transition (such as when entering or leaving a low power mode during operation after boot-up) happens within external regulation mode. The related art does not consider how mode entry-exit may be guaranteed with external regulators in terms of load handling, overshoot, undershoot, etc.

d) Hardware indicator—There is no hardware notifier that can make a test case fail.

Figure 4:
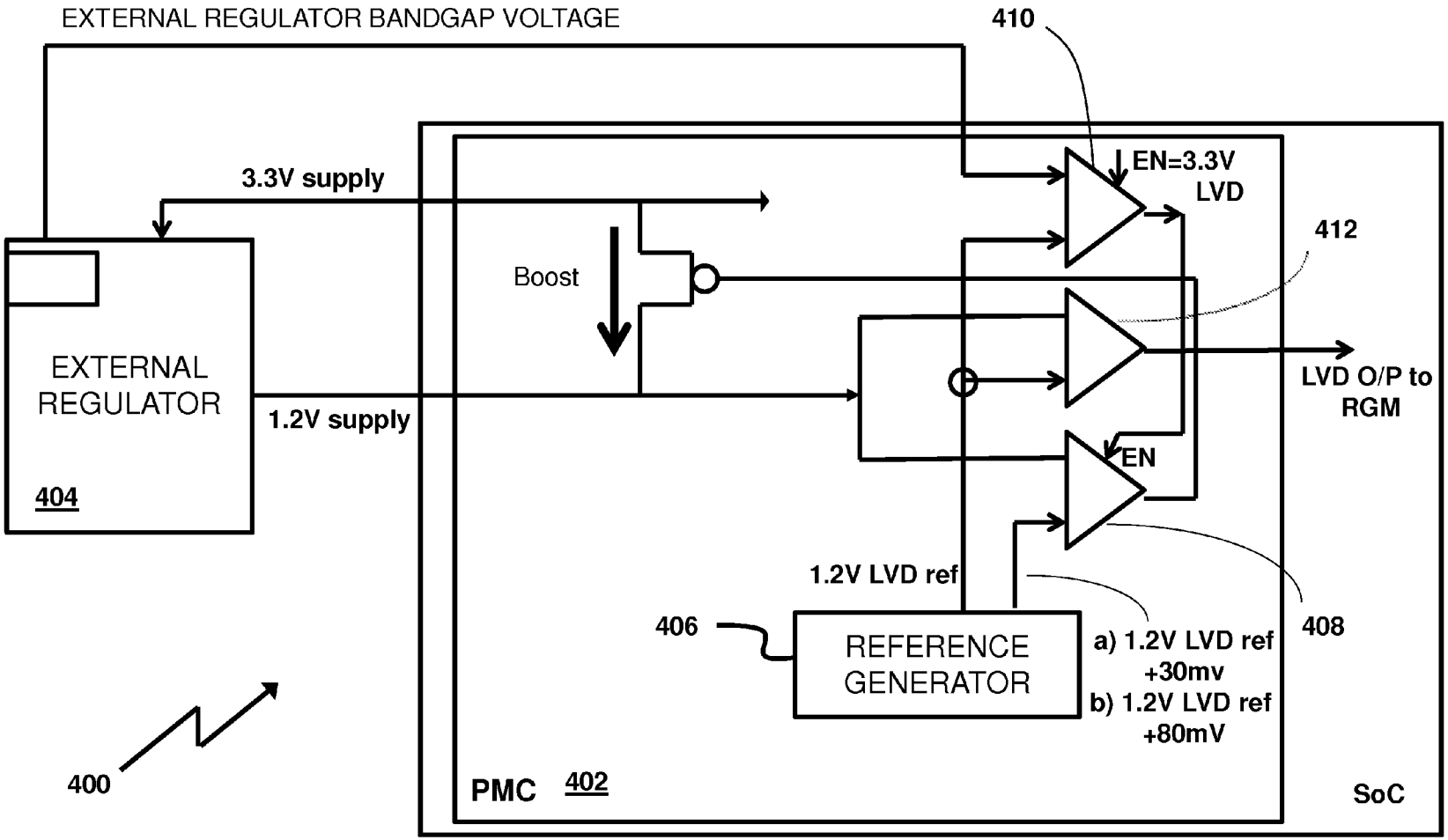
FIG. 4 is a schematic circuit diagram of voltage regulator circuitry in accordance with certain embodiments of the present invention.

FIG. 4 is a schematic block diagram of voltage regulator circuitry in accordance with certain embodiments of the present invention. FIG. 4 shows a SoC 400 including an analog PMC 402. The PMC 402 is electrically connected to an external regulator 404 and receives a supply voltage (at a nominal 3.3V) from an external supply. The external regulator 404 operates to supply a regulated reduced voltage supply (at a nominal 1.2V) to the PMC 402. The PMC 402 includes an internal reference voltage generator 406 (having a corresponding internal bandgap), an AUX regulator 408 and a bandgap comparator 410.

The PMC 402 further includes a further comparator, i.e., an operational amplifier 412 configured in an open loop mode, such that its output would be either VDD (the highest voltage) or VSS (the lowest voltage). The operational amplifier 412 generates an output signal that is applied to a reset manager (RGM, not shown), which then performs a reset procedure in the SoC 400.

The enablement of the AUX regulator 408 is dependent upon a sensed value of the external regulator 404 bandgap voltage. The external regulator 404 includes a feedback node at which the external bandgap voltage may be sensed. An interface is provided in the PMC 402 to receive signals from the feedback node. The external bandgap interface is applied to the non-inverting pin of the bandgap comparator 410 where it is compared with the internal LVD reference.

If the external bandgap voltage is determined to be lower than the LVD reference with minimal offset, the bandgap comparator 410 enables the AUX regulator 408 in overdrive mode, which is represented by the application of a signal at LVD ref+80 mV. Overdrive is assumed for as long as the operational amplifier 412 generates no output signal to the reset manager or until the LVDs are de-asserted.

In certain embodiments, the AUX regulator 408 is enabled at power up, provided external core voltage supply is less than 1.2V LVD Ref+untrim variation.

In certain embodiments, the AUX regulator 408 can be disabled by the customer (if he chooses to) by writing into a suitable register, e.g., a register storing enablement flag data.

Once the AUX regulator 408 is enabled, the reduced voltage supply 1.2V VDD is boosted until it exceeds the untrimmed 1.2V LVD reference. The boosted 1.2V VDD then triggers the operational amplifier 412 to generate an output signal to the reset manager (RGM, not shown) that makes the reset manager move to Phase 3 (i.e., to reset the SoC 400).

Once trims are loaded from flash memory during a later phase of reset, the AUX regulator 408 will be trimmed back to LVD+30 mV range (step a)).

The AUX regulator 408 is typically then enabled in an under-drive mode while in the ON State. However, whether the output of the bandgap comparator 410 goes HIGH or LOW thereafter depends on load transitions. As a result, the AUX regulator 408 functions thereafter as a current boost during load transitions.

It is noted that the AUX regulator 408, operating as an internal regulator, may nonetheless give rise to contention with an external regulator. This contention is however limited to the scale time for trim loading (of the order of 50 microseconds or less), which represents a significant improvement over the conventional circuit where over-drive conditions may arise throughout ramp time (which is typically in the order of tens of milliseconds in duration, and therefore much longer than the scale time).

It is also noted that the bandgap comparator 410 is enabled only when the LVD of the 3.3V supply is not asserted. The AUX regulator 408 will remain disabled if 3.3V LVD is asserted (at the bandgap comparator 410) as this indicates references (in particular, the 1.2V LVD reference) may not be stable. This gating ensures that the bandgap comparator 410 only starts after the bandgap and the LVD references inside the PMC 402 have become stable. Furthermore, the AUX regulator 408 will also remain disabled during start-up if the external bandgap voltage is greater than the internal LVD reference voltage.

As a result of the above, certain embodiments facilitate the maintenance of internal LVD references while the regulator system operates in external regulation mode without giving cause for concern about the untrimmed range of LVD reference signals.

As the AUX regulator 408 does not need to be enabled during POR, the potential for ESD spikes is significantly diminished.

It is known to provide an external LVD indicator in an external regulator, which may be used when internal LVDs are disabled, referred to as a POR_FROM_PAD. In certain embodiments, the POR_FROM_PAD may be considered unnecessary; where present, the POR_FROM_PAD may be repurposed as the feedback node for sensing external bandgap voltage.

Conveniently, in certain embodiments, the AUX regulator 408 operates during load transition in substantially the same way as AUX regulators in the conventional circuits. The load transition behavior remains unchanged and the PMC 402 continues to work in a manner familiar to users of conventional voltage regulation systems.

During shutdown, once 3.3V supply LVD is asserted (i.e., the bandgap comparator 410 is disabled), the AUX regulator 408 can never be enabled and hence avoids the contention as present in the prior art. The assertion of the 3.3V supply LVD also indicates that the system is robust during power down or ramp down phase.

A further benefit of certain embodiments of the present disclosure is that the power supply can be specified without additional margins of tolerance for untrimmed LVD range. This is significant since supply voltage that is higher than necessary can be considered to correspond to excess consumed power: power being proportional to voltage. Likewise, untrimmed LVD range need not be restricted to values so low that Vmin problems arise.

It is known to model on-board voltage regulators and to test performance during load transition to check that the voltage remains within a predefined range: i.e., above the LVD threshold (say 1.08V) and below the HVD threshold (say 1.32V).

Figure 5:
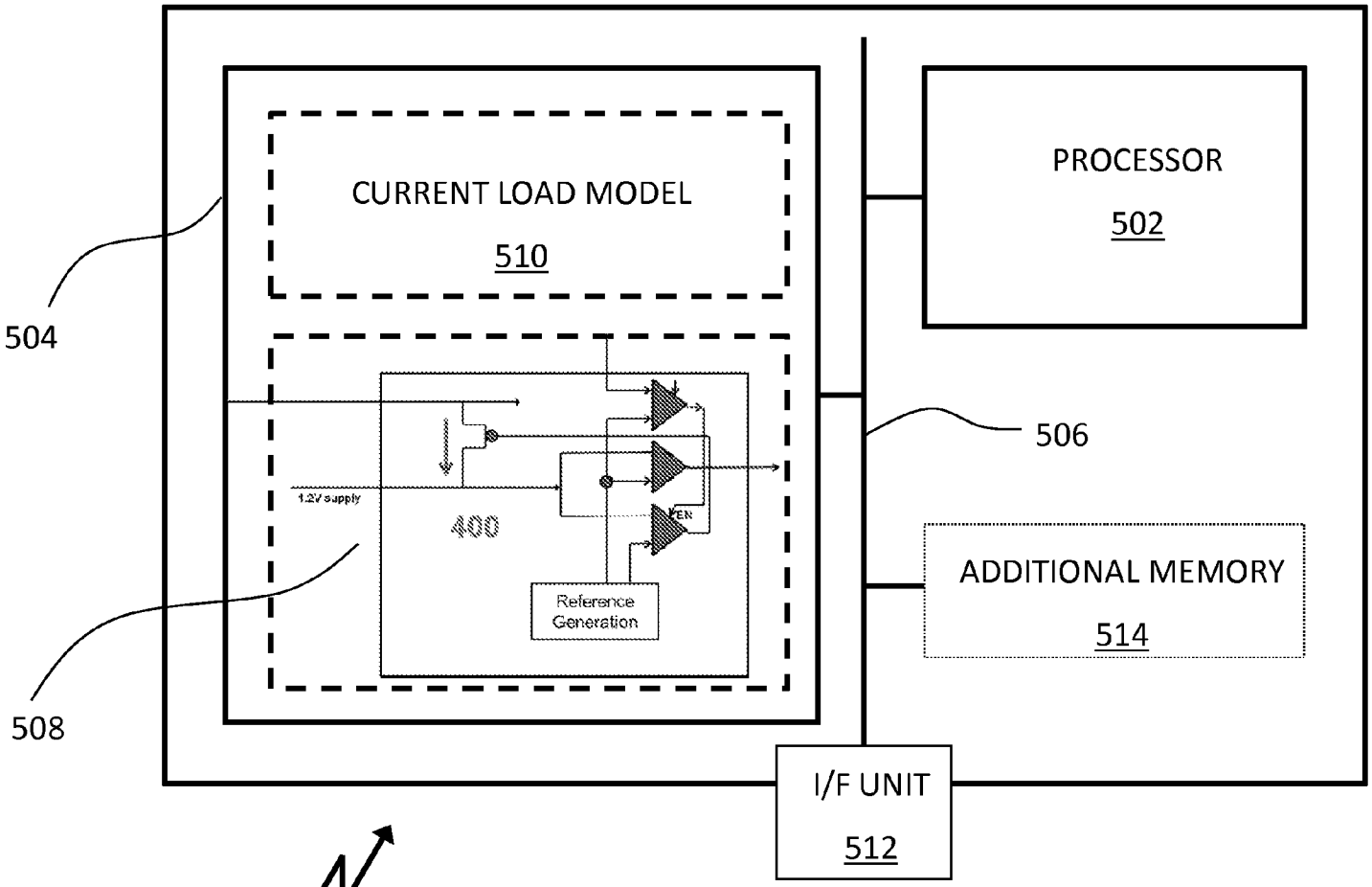
FIG. 5 is a schematic block diagram of an electronic design verification apparatus suitable for verifying multi-regulation subsystems having an external regulation mode.

FIG. 5 is a block diagram of an electronic design verification apparatus 500 suitable for verifying multi-regulation subsystems having an external regulation mode. The apparatus 500 includes a processor 502 and a memory 504 communicatively coupled via a bus 506. Information corresponding to an integrated circuit design 508 is stored in the memory 504 (for instance, in FIG. 5, the circuit design 400 of FIG. 4 is shown) and a predefined current load model 510 of the integrated circuit design 400. The apparatus 500 may also be used to verify conventional integrated circuit designs such as those in FIGS. 1 and 3. The apparatus 500 is conveniently provided with at least one interface unit 512 for providing an interface to peripheral input and output devices (such as a computer mouse, keyboard, touch pad, displays and printers) and to other computing devices (via a wired or wireless network) and additional memory 514 for storing applications including a graphical user interface (GUI) application for generating a human-machine interface (such as displaying the output of the verification methods in a graphical form).

The electronic design verification apparatus 500 is configured to verify power management in the circuit design 508, where the circuit design 508 includes an auxiliary regulator, a bandgap comparator and a plurality of load modules. The electronic design verification apparatus 500 performs steps including:

estimating a current load requirement of the load modules based on a predefined current load model;

executing predetermined test patterns in conjunction with the estimated current load requirement, where the test patterns including patterns corresponding to one or more of start-up, mode transition and load transition;

comparing, for each test pattern, in the bandgap comparator, an external regulator bandgap with an internal reference voltage;

outputting a comparison signal from the bandgap comparator to the auxiliary regulator;

enabling the auxiliary regulator if the comparison signal indicates that the external regulator bandgap voltage is less than the internal reference voltage and a predetermined offset;

monitoring a voltage supplied to the integrated circuit design;

regulating the voltage supplied to the integrated circuit design using the enabled auxiliary regulator, where the enabled auxiliary regulator boosts the supply voltage in accordance with a predetermined criterion; and verifying that the supply voltage regulation performed by the auxiliary regulator, which is based on the estimated current load requirement, does not deviate from a predetermined operating voltage of the integrated circuit design.

When applied to the circuit design 100 in FIG. 1 (or FIG. 2), the power management of the circuit design 100 is verified using suitable electronic design automation (EDA) tools. EDA tools include mixed signal verification tools that can simulate digital and analog circuits together, such as Incisive™ Unified Simulator (IUS) by Cadence Design Systems, Inc. The first and second voltage regulators 102 and 104, and the first and second de-coupling capacitors 107 and 108 are simulated using an analog hardware descriptive language (HDL), such as SPICE or Verilog AMS (VAMS). The first and second voltage regulators 102 and 104, and the first and second de-coupling capacitors 107 and 108 may be modeled at the SPICE or behavioral level during the simulation. The circuit module 106 also is translated to a current load model using the analog HDL. The entire simulation including digital and analog models runs on a mixed-signal simulator. Analog mixed signal (AMS) verification test patterns may be used for verifying transitions from all possible mode crossovers by dynamically generating current load models.

In certain other embodiments, there is provided a parameterized analog HDL model (i.e., a VAMS model) for an external regulator that can be modelled with parameters of bandwidth, regulation level, VDDMIN-VDDMAX range, negative current injection, Hardware notifier—RESET pin, shutoff condition for mode transition and wakeup indication from WKPU.

The purpose of the expanded model is to support the following:

a) Startup check—Check negative current to indicate that AUX regulators are starting up faster than the typical timescale for voltage fluctuations upon start-up. If not, this check may indicate a failure condition.

b) Load handling check—If conventional modelling of circuitry having both main regulator and AUX regulator on-board indicates regulation level (parameterized), falls outside VDDMIN_VDDMAX range, RESET pin will get an assert pulse giving a reset to SoC and failing the testcase. A further check is made to confirm whether AUX regulator(s) are able to handle worst case load profile using the conventional model and whether they are designed to respond effectively to load surges. This check may also indicate the presence of latency. Power Credit Based Fair Scheduler (PCFS) recommendations can be verified "pre-silicon" (i.e., before a circuit design is fabricated on a silicon wafer) and recommendations can be given in Design Specifications to customers: the design specification being the Reference Manual of the SoC that is provided along with any chip that a company sells to a customer. The design specification typically contains a detailed description of the design and details of its usage.

c) Scan mode—When a scan mode is used to generate voltage shmoo plots (e.g., to check the Vmin, timing closure, max operable frequency, etc.), there can be a problem if internal regulators turn ON unexpectedly: voltage may vary outside the VDDMIN-VDDMAX range and the reset pin will assert to clear the system.

d) Mode transition—Model entry-exit profiles, load handling when wakeup happens and clocks reappear (this may happen during POR procedure or according to a wakeup protocol; certain clocks like those in phase-locked loops, PLLs, are switched OFF before going into a Low Power mode), check if external regulator can handle load surges during entry-exit sequence, and check if LVD is unintentionally impacted.

In other words, certain embodiments provide verification methods that allow the modelling of hitherto ignored problem scenarios and to verify the architectures described above. These embodiments permit: the checking of contention with external power supply; the checking of scan mode operation configurations; and determine whether low power mode transition has any limitations.

Certain verification methods use an analog regulator model and simulate external board regulator behaviour. When a voltage is generated from the model, and a range of loads corresponding to conventional models of circuitry having both main regulator and AUX regulator on-board are applied, the method replicates the behaviour of the external regulator due to SoC activity. The verification methods are configured to allow unconventional hardware functionality, such as the robust boot procedure described above, to be verified. This verification includes intentionally operating an external regulator at voltages below the untrimmed LVD, then determining whether the AUX regulator can be enabled by the hardware and taking the voltage to a level above the untrimmed LVD and bringing the chip out of reset.

The description of the preferred embodiments of the present invention has been presented for purposes of illustration and description, but is not intended to be exhaustive or to limit the invention to the forms disclosed. It will be appreciated by those skilled in the art that changes could be made to the embodiments described above without departing from the broad inventive concept thereof. It is understood, therefore, that this invention is not limited to the particular embodiment disclosed, but covers modifications within the spirit and scope of the present invention as defined by the appended claims.

The invention claimed is:

1. A voltage regulation system for regulating voltage in an integrated circuit, the system comprising:

an auxiliary regulator;

a bandgap comparator; and an interface with an external regulator, wherein the bandgap comparator compares an external regulator bandgap voltage with an internal reference voltage and outputs a comparison signal to the auxiliary regulator, wherein the auxiliary regulator is enabled if the comparison signal indicates that the external regulator bandgap voltage is less than the internal reference voltage and a predetermined offset, wherein the enabled auxiliary regulator boosts a first supply voltage in accordance with predetermined criteria, thereby ensuring that the integrated circuit exits reset, wherein the bandgap comparator is enabled only when the reference voltage is determined to be stable, wherein the first supply voltage is boosted using a second supply voltage, the second supply voltage being higher than the first supply voltage, wherein the second supply voltage also is supplied to a low voltage detection (LVD) unit, said LVD unit monitoring whether the second supply voltage falls below an LVD threshold value, and wherein the bandgap comparator is disabled when the second supply voltage falls below the LVD threshold.

2. The system of claim 1, wherein the second supply voltage provides the voltage for the external regulator, thereby ensuring that the bandgap comparator is enabled only when the bandgap voltage is stable because the voltage at the external regulator is above the LVD threshold.

3. The system of claim 1, further comprising an operational amplifier communicatively coupled to a reset generation module, wherein the operational amplifier receives the supply voltage and compares the supply voltage to the internal reference voltage, and outputs a second comparison signal to the reset generation module indicating whether the supply voltage exceeds the internal reference voltage, and wherein the auxiliary regulator ensures that the integrated circuit exits reset by boosting the supply voltage to exceed the internal reference voltage.

4. The system of claim 1, wherein the auxiliary regulator is enabled during a mode of the integrated circuit changes between power-on and power-off states.

5. The system of claim 1, wherein the internal reference voltage is untrimmed during electronic circuit reset, said internal reference voltage varying across an untrimmed range of voltage values.

6. The system of claim 1, wherein the auxiliary regulator is enabled during load transitions.

7. The system of claim 6, wherein the internal reference voltage is trimmed during load transitions, the internal reference voltage varying across a trimmed range of voltage values, wherein the trimmed range is narrower than an untrimmed range.

8. A method for regulating voltage in an electronic circuit, the method comprising:

receiving an external regulator bandgap from a first voltage regulator, said first voltage regulator being external to the electronic circuit;

receiving an internal reference voltage from a reference generator, said reference generator being internal to the electronic circuit;

determining whether the external regulator bandgap is stable;

comparing, in a bandgap comparator unit, the external regulator bandgap with the internal reference voltage;

outputting a comparison signal to an auxiliary regulator;

enabling the auxiliary regulator if the comparison signal indicates that the external regulator bandgap is less than the internal reference voltage and a predetermined offset;

boosting, at the enabled auxiliary regulator, a supply voltage in accordance with a predetermined criterion, thereby ensuring that the electronic circuit comes out of reset, enabling the bandgap comparator unit only when the external regulator bandgap is stable; and wherein:

the supply voltage is boosted using a second supply voltage that is higher than the supply voltage, the second supply voltage is also supplied to a low voltage detection, LVD, unit that monitors whether the second supply voltage falls below an LVD threshold, and determining whether the external regulator bandgap is stable comprises determining that the second supply voltage exceeds the LVD threshold.

9. The method of claim 8, wherein the second supply voltage provides the voltage for the external regulator, thereby ensuring that the bandgap comparator unit is enabled only when the bandgap is stable because the voltage at the external regulator exceeds the LVD threshold.

10. The method of claim 8, further comprising, in an operational amplifier communicatively coupled to a reset generation module:

receiving the supply voltage;

comparing said supply voltage to the internal reference voltage; and outputting a second comparison signal to the reset generation module indicating whether the supply voltage exceeds the internal reference voltage, and wherein the predetermined criterion for the auxiliary regulator requires the supply voltage to exceed the internal reference voltage.

11. The method of claim 8, wherein the internal reference voltage is untrimmed during electronic circuit reset, said internal reference voltage varying across an untrimmed range of voltage values.

12. The method of claim 8, further comprising enabling the auxiliary regulator during load transitions.

13. The method of claim 12, wherein the internal reference voltage is trimmed during load transitions, said internal reference voltage varying across a trimmed range of voltage values and said trimmed range being narrower than an untrimmed range.

* * * * *